United States Patent [19]

Bennett

[11] 4,148,094

[45] Apr. 3, 1979

[54] COMBINED SPOT AND SIGNAL LIGHT

[75] Inventor: Lester H. Bennett, Los Alamitos, Calif.

[73] Assignee: Bon Aire Industries, Inc., Signal Hill, Calif.

[21] Appl. No.: 792,895

[22] Filed: May 2, 1977

[51] Int. Cl.[2] ..... F21V 33/00

[52] U.S. Cl. ..... 362/109; 362/255; 362/292; 362/306

[58] Field of Search ..... 362/61, 255, 290, 2, 362/4, 266, 306, 342, 394, 109, 145; 340/340, 342

[56] References Cited

U.S. PATENT DOCUMENTS

| | | | |
|---|---|---|---|
| 674,770 | 5/1901 | Hull | 362/61 |
| 1,767,756 | 6/1930 | Hall | 362/321 X |
| 1,882,137 | 10/1932 | Fruchtenicht | 362/295 X |
| 1,998,823 | 4/1935 | Schmidinger et al. | 340/342 |
| 2,403,646 | 7/1946 | Falge et al. | 362/61 X |
| 2,415,120 | 2/1947 | Whiting | 362/61 X |
| 2,507,552 | 5/1950 | Teele | 362/321 X |
| 2,580,956 | 1/1952 | Reddick | 362/109 X |
| 2,674,726 | 4/1954 | Williams | 340/340 X |
| 2,957,389 | 10/1960 | Moore | 362/109 X |
| 3,431,408 | 3/1969 | Roosevelt | 362/61 |
| 3,696,238 | 10/1972 | Szymanski | 362/321 X |
| 3,743,380 | 7/1973 | Fugitt | 362/109 X |

*Primary Examiner*—Peter A. Nelson

*Attorney, Agent, or Firm*—Fulwider, Patton, Rieber, Lee & Utecht

[57] ABSTRACT

A combined portable spotlight and signal light provided by a narrow beam spotlight and a plurality of colored lenses which disperse the narrow beam into a relatively wide beam which is characteristic of a signal light. Either continuous light or an intermittent flashing light may be switch selected. The lenses include vertically oriented fluted segments to provide a generally horizontal light dispersal and the housing for the light is square to provide numerous mounting positions and provide a distinctive square signal light.

7 Claims, 9 Drawing Figures

FIG. 1
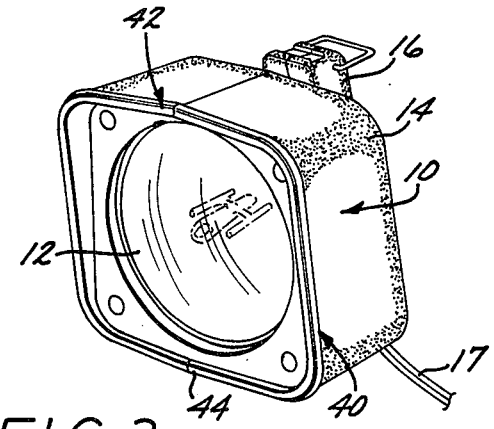
FIG. 2
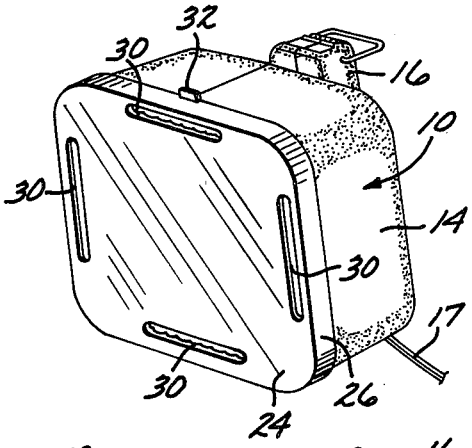
FIG. 3
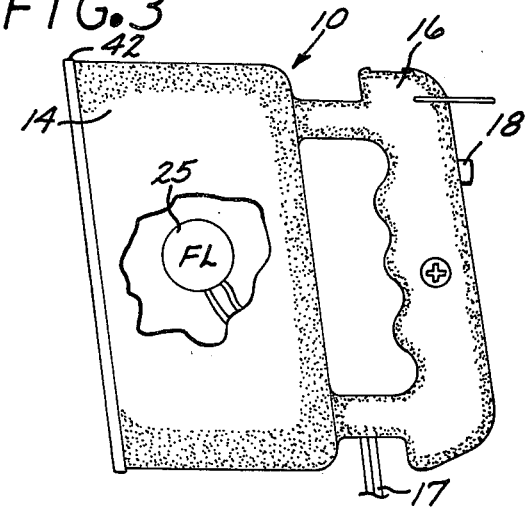
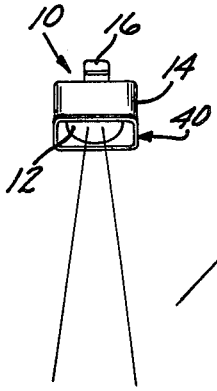
FIG. 6
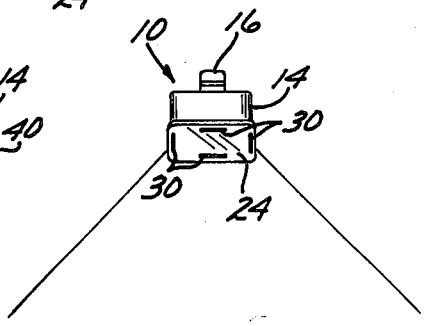
FIG. 7
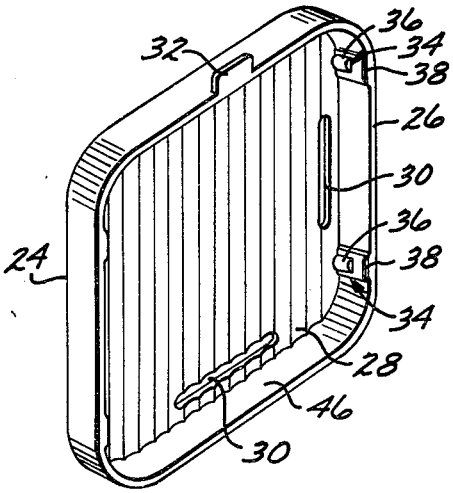
FIG. 4
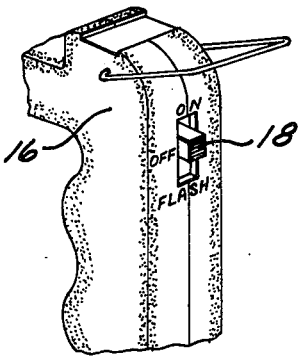
FIG. 5
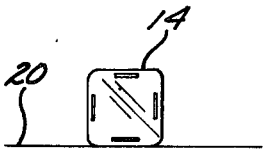
FIG. 8A
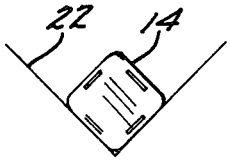
FIG. 8B

COMBINED SPOT AND SIGNAL LIGHT

BACKGROUND OF THE INVENTION

1. Field of the Invention

The present invention relates generally to light sources and, more particularly, to such a light source which can perform multiple functions.

2. Descripion of the Prior Art

Other than flashlights with detachable colored discs which fit over the protective clear plate over the bulb, no relavant prior art is known.

SUMMARY OF THE INVENTION

The present invention provides a combined spotlight and signal light employing a high intensity, relatively narrow beam spotlight which is mounted in a housing adapted to receive in place over the beam one or more lenses which disperse the beam into a relatively wide angle signal light. The lenses are colored and, for the presently preferred embodiment of the invention, have vertically oriented fluted lens segments which disperse the light in a predominantly horizontal orientation. The housing for the spotlight is rectangularly shaped and preferably square which permits it to be positioned in a plurality of attitudes, such as on a horizontal flat surface or in the crux of a V-shaped structure.

The spotlight beam may be switch selected to be either continuous or intermittently flashed so that when the light is combined with the colored lenses, the commonly recognizable warning and distress signals may be displayed.

A handle is incorporated into the housing for the spotlight to provide easy handheld portable use of the spotlight itself for numerous tasks.

Each of the lenses has elongated apertures along their edges for ventilation and an index tab whereby the proper orientation of the lens is easily accomplished. The lens is held in place on the housing by means of snap release tabs along the vertical edges of the lens and the bottom and top of the housing edges are slightly V-shaped to register the lens in place on the housing.

These and other features of the present invention will become apparent from the following detailed description.

BRIEF DESCRIPTION OF THE DRAWINGS

FIG. 1 is a perspective view of the spotlight and its housing utilized with the present invention;

FIG. 2 is another perspective view of the housing of the present invention with a lens in place;

FIG. 3 is a side elevational view of the housing;

FIG. 4 is a perspective view of the backside of a lens;

FIG. 5 is a partial perspective view of the back of the handle of the controlling thumb switch;

FIG. 6 is a diagrammatic illustration of the relatively narrow beam of the spotlight;

FIG. 7 is a diagrammatic view of the dispersal effects of a lens;

FIG. 8A is a diagrammatic view of one mounting attitude for the rectangular housing; and FIG. 8B is another diagrammatic view illustrating a second mounting attitude for the housing.

DESCRIPTION OF THE PREFERRED EMBODIMENT

Turning now to the drawings, FIG. 1 is a perspective view of a combination of a spotlight and signal light 10 constructed in accordance with the present invention, shown without a dispersing lens. Basically, the combined light 10 includes a high intensity quartz-iodine lamp 12 which is integrally constructed into a sealed beam lamp. The sealed beam lamp 12 produces a relatively narrow beam of intense light which is diagrammatically illustrated in FIG. 6.

The sealed beam light 12 is mounted within a housing 14 which includes a handle 16 as is best seen in FIG. 3 to provide a handheld high intensity light for general usage. The light 12 is conventionally powered by a vehicle battery through a cable 17.

A switch 18 mounted on the back of the handle, positioned for thumb manipulation has three functions: a center "off" position, a first position which provides a continuous light, and a second position which provides an intermittent flashing light which may be utilized in emergency or signalling situations, as will be described below.

The housing 14 is rectangular in shape, and in the presently preferred embodiment is square, so that the combined lamp 12 and housing 14 may be positioned for use in numerous ways, as illustrated diagrammatically in FIGS. 8A and 8B. In particular, the housing 14 may be simply set onto a flat surface 20 as shown in FIG. 8A, or a corner of the housing may be set into a notch or V-shaped structure 22 which may occur as any raised or sloping portion of a car or tree or the like.

FIG. 2 is a perspective view of the combined spotlight and signal light of the invention 10 shown with a dispersing lens 24 in place on the front of the housing 14. Basically, the dispersing lens 24 disperses the relatively narrow beam from the spotlight 12 as shown in FIG. 6 into a relatively wide beam light characteristic of a signal light, as is diagrammatically illustrated in FIG. 7. In addition to the dispersal of the light, the square shape of the signal light produced by the lens 24 is distinctive and therefore more recognizable than would be a simple round signal light.

The signal light generated with the lens 24 in place on the housing 14 may be selectively either continuous or intermittently flashing, depending upon the position of the switch 18, as discussed above. The intermittent flashing characteristic is provided by a conventional flasher unit 25 mounted on an inside wall of the housing 14, as shown in FIG. 3. Thus, continuous or flashing lights such as amber or red may be generated which are conventionally recognized as warning and distress lights, respectively. Therefore, by placing the desired lens 24 on the housing 14, and positioning the housing at some visible location such as near a stalled car or the like, a warning or distress signal will be shown to anyone approaching.

The lens 24 is basically square in structure with rounded corners and has an inwardly directed mounting flange 26 as is best illustrated in FIG. 4. In addition, the inside surface of the lens is constructed with lens segments which are vertically oriented and arcuate or flute shaped, such as the segment 28 shown in FIG. 4. The vertically oriented fluted lens structure provides a dispersal of the light from the lamp 12 into a relatively wide beam which is substantially horizontal rather than vertical. Thus, the useful light from the lamp 12 is substantially concentrated in a horizontal attitude which is typically from where the signal will be seen.

Due to the intense nature of the light from the lamp 12, great heat is generated and the lens 24 is provided with elongated apertures 30 along each vertical and horizontal edge, as is best seen in FIG. 2. In addition, in order to insure the proper vertical orientation of the fluted lens segments 28 even under adverse circumstances such as darkness, an index tab is provided along what will be designated as the top of the lens.

The lens 24 is held in place on the front of the housing 14 by means of a pair of detachable snap-on clips 34 which include a spacing pad 36 which cooperates with a small lip 38 to detachably engage the bulbously shaped outer edge 40 of the housing 14.

In addition, in order to insure vertical registry of the lens 24 on the housing 14, the top and bottom outer edges 42 and 44, respectively, of the housing, are slightly V-shaped with the apex being outwardly directed from the center of the top and bottom edges 42 and 44, respectively. The apexes of these V-shaped edges engage the inside 46 of the lens 24 with slight flexure to register the lens 24 on the housing 14.

Thus, the combined spotlight and signal light of the present invention provides a portable handheld high intensity spotlight of general utility with provision for the fast and simple conversion of the spotlight into a warning or distress light by the attachment of a lens in front of the spotlight which disperses the narrow beam of the light into a relatively wide beam characteristic of a signal light which additionally is of a square shape for easy identification. The lens 24 has vertically oriented fluted lens segments which disperse the light in a generally horizontal direction which is the orientation of greatest utility. The lens 24 is ventilated and is snapped into position on the housing with a pad and lip which engage a bulbous edge of the housing on its vertical sides and vertical registry is maintained by slightly V-shaped top and bottom edges of the outer edge of the housing. The light provided may be either continuous or intermittently flashing which when combined with lenses of particular colors such as amber and red create generally recognizable warning and distress signals. The square shape of the housing 14 permit its positioning in various attitudes on diverse structures.

While a particular preferred embodiment of the present invention has been described in detail, it should be appreciated that numerous modifications are possible and the invention is not to be limited, except by the following claims.

I claim:

1. A combination spotlight and signal light comprising:

a sealed beam spotlight mounted in a housing having a handle, and including spotlight means having a first relatively narrow beam;

switch means for selectively switching said spotlight between an "off" condition, a continuous "on" condition and an intermittent flashing condition; and at least one signal lens for mounting on said housing, in the path of said narrow beam, said lens being appropriately colored to indicate the desired signal and constructed to disperse said first beam into a second beam of a relatively wide angle when compared to said first relatively narrow beam from said spotlight; and fastner means for detachably mounting said signal lens on said housing.

2. The combination spotlight and signal light defined in claim 1, wherein:

said housing and lens are rectangular.

3. The combination spotlight and signal light defined in claim 1, wherein:

a side of said lens facing said spotlight is vertically fluted.

4. The combination spotlight and signal light defined in claim 3, wherein:

a top of said lens has an indexing tab to aid in proper orientation of the lens with the fluted surface in a vertical orientation.

5. The combination spotlight and signal light defined in claim 3, wherein:

said lens includes elongated ventilation apertures along each edge of said lens.

6. The combination spotlight and signal light defined in claim 5, wherein:

said lens has a mounting flange which detachably engages the sides of said housing, said mounting flange including a plurality of spacing pads which engage the front edge of said housing and associated snapping lips which engage a bulbous, outwardly directed side of said front edge.

7. The combination spotlight and signal light defined in claim 6, wherein:

The top and bottom edges of said housing are V-shaped with their apexes centrally directed outwardly to engage the top and bottom portions of said mounting flange to vertically register the lens.

* * * * *